United States Patent [19]

Yamazaki

[11] Patent Number: 5,008,498

[45] Date of Patent: Apr. 16, 1991

[54] ROTARY SWITCH

[76] Inventor: Atsuo Yamazaki, c/o Iruma Center, Copal Electronics Co. Ltd. No. 110-1, Shimoshinden, Araku, Iruma City, Saitama Prefecture, Japan

[21] Appl. No.: 461,549

[22] Filed: Jan. 5, 1990

Related U.S. Application Data

[62] Division of Ser. No. 376,599, Jul. 7, 1989.

[30] Foreign Application Priority Data

Aug. 11, 1989 [JP] Japan ..... 1-106294[U]
Aug. 11, 1989 [JP] Japan ..... 1-200966
Aug. 23, 1989 [JP] Japan ..... 1-110242[U]

[51] Int. Cl.[5] ..... H01H 19/60; H01H 21/80

[52] U.S. Cl. ..... 200/11 R; 200/565; 200/303

[58] Field of Search ..... 200/11 R, 11 G, 6 B, 200/6 BA, 6 BB, 293, 303, 6 R, 564, 565, 569

[56] References Cited

U.S. PATENT DOCUMENTS 2,648,730 8/1953 Wellworth ..... 200/303 X
2,659,792 11/1953 Boardman ..... 200/303 X
3,470,333 9/1969 Schneider et al. ..... 200/11 G
4,016,387 4/1977 Aberer ..... 200/303
4,071,720 1/1978 Kracji et al. ..... 200/303 X
4,133,990 1/1979 Wanner et al. ..... 200/303 X
4,239,947 12/1980 Breitung et al. ..... 200/303 X
4,766,277 8/1988 Bigelow, Jr. ..... 200/303 X
4,855,541 8/1989 Yamashita et al. ..... 200/565 X
4,894,500 1/1990 Yamazaki et al. ..... 200/565
4,945,195 7/1990 Ipcinski ..... 200/569 X

*Primary Examiner*—J. R. Scott
*Attorney, Agent, or Firm*—Wenderoth, Lind & Ponack

[57] ABSTRACT

A rotary switch has a case, a housing, and a rotor rotatably arranged in a chamber of the housing. The housing carries a pair of projections on both side walls and a pair of corner projections together with a pair of grooves defined in the bottom center thereof, while the case has a pair of bent legs in the center of which are defined holes to receive the side wall projections of the housing and the undersurface of which extend to form a pair of depending lugs which may be crimped inwardly into a pair of grooves defined in the housing. A contact member positioned between rotor and the housing carries a plurality of contact fingers provided with contact projections having contact points one of which may be contacted, in accordance with the rotation of the rotor, on one of the terminal lead contacts spaced around the housing chamber caused by slidable touching on one of the contact projections by means of a cam pattern provided on a circuit board attached to the rotor.

1 Claim, 7 Drawing Sheets

ROTARY SWITCH

This application is a divisional application of Ser. No. 07/376,599, filed Jul. 7, 1989.

BACKGROUND OF THE INVENTION

The present invention relates to a rotary switch and more specifically to a miniature rotary switch assembly which is most suited for installation on a circuit board. Recently, there has been a strong demand in the market for a miniature rotary switch of this sort.

a prior art rotary switch disclosed in Japanese provisional utility model publications Nos. 149339, 149340/1984 has a rotor rotatably held in a cavity formed by a housing and a case. On the under surface of the rotor is disposed a contact with a pattern which wipably touches by turn on any one of contact projections of a contact member positioned between the rotor and the housing upon the rotation of the rotor whereby at least one of the fixed contact elements of the terminal leads on the housing electrically connected with a contact projection of the contact member.

As shown in FIGS. 12 through 15, a rotary switch of the prior art disclosed in the Japanese provisional publications listed above has a housing 91 provided with terminal pins 92, 93, 94, 95 and 96 insertably moulded therein. The ends of the terminal pins 92–96 are exposed on the surface of the housing 91 as illustrated by hatched portions and define fixed contacts 97, 98 99, 100 and 101 to which are respectively assigned one of the values 1, 2, 4, 8 of the binary number system or the decimal number system.

It should be noted that the numerals 96 and 101 represent a common terminal pin and a common fixed contact respectively.

A piece of contact member 102 which is composed of a square planar conductive metal plate carries a plurality of contact fingers $102_1$, $102_2$, $102_3$, $102_4$, and $102_5$, numeral $102_3$ being a common contact finger facing to a common fixed contact 101.

The contact fingers $102_1$–$102_5$ extend alternately in opposite directions as shown in FIG. 15. For example, the contact finger $102_1$ extends to the right while the contact finger $102_2$ extends to the left in to FIG. 15. The same directional arrangement exists between the finger $102_3$ and the finger $102_4$. The contact fingers $102_1$, $102_2$, $102_3$, $102_4$and $102_5$ are spaced from and opposed to fixed contacts 97, 98, 101, 99 and 100 of terminal pins 92–96 respectively leaving a small clearance therebetween.

Upon the middle surface of the contact fingers $102_1$,–$102_5$ are positioned projections $102_6$ respectively. These projections $102_6$ are insertably held in holes h defined in a holder plate 107 positioned unmovably underneath a rotor 104.

The holder plate 107 helps to keep each contact member 102 at its set position by preventing undesirable shifting thereof by means of holes h which hold the projections $102_6$ of contact fingers $102_1$–$102_5$ therethrough.

As is shown in FIG. 12, a case 103 is fitted to the housing 91 to form a cavity C therebetween and the rotor 104 is rotatably held captive therein. As heretofore explained the holder plate 107 is arranged unmovably between the undersurface of the rotor 104 and the upper surface of the housing 91. A slot $104_2$ is defined in the middle surface of the rotor head $104_1$. The rotor 104 is rotated as by, for example the rotation of a screw driver or the like engaged in the slot $104_2$.

An O-ring 105 is positioned in a clearance formed between the case 103 and the rotor 104 thereby to prevent undesired material (e.g. dust or grease) from passing inwardly toward the cavity C.

On the undersurface of the rotor 104 is arranged a cam pattern 110 provided with a circumferential cam 108 (as indicated by hatched portions) concentric with a center groove 109 of the rotor 104 and with a plurality of tapered cams $104_4$ having tapered sections $104_6$ and $104_7$ and a top projections $104_5$ as illustrated by hatched portions which are disposed along the periphery of the rotor 104.

Upon the rotation of the rotor 104, the cam pattern 110 rotates therewith. The circumferential cam 108 continuously and wipably touches on the projection $102_6$ disposed on the common contact finger $102_3$ whereby an electrical connection between the common terminal pin 96 and the common finger contact $102_3$ of the contact member 102 is continuously performed, while a plurality of tapered cams $104_4$ touch on the projections $102_6$ disposed on the finger contact $102_1$, $102_2$, $102_4$ and $102_5$ in seriatim whereby an electrical connection between the terminal pins 97, 98, 99 and 100 and the finger contacts $102_1$, $102_2$, $102_4$, $102_5$ are performed respectively.

The prior art contact member 102 is square in shape and provided with contact fingers $102_1$, $102_2$, $102_4$, $102_5$ alternately and oppositely arranged facing fixed contacts 97–101 of terminal pins 92–96 leaving a small clearance therebetween. In order to maintain the contact fingers $102_1$–$102_5$ at their set positions, the holder plate 107 positioned underneath the rotor 104 is provided such that the projection $102_6$ of the contact fingers $102_1$–$102_5$ are insertably held by the holes h defined therein to keep the contact member 102 at its set position.

BRIEF SUMMARY OF THE INVENTION

The prior art contact member described above requires a complicated manufacturing procedure. This is a result of the complicated assembling of component parts including the holder plate, etc.

Furthermore, an accurate positioning of contact fingers of the contact member may not be obtained because of shaky insertion of the projection disposed on the contact finger into the holes defined in the holder plate.

It is an object of this invention to provide a simple contact member which does not require any separate holder plate.

The prior art rotary switch has the case fittedly assembled in the housing thereby to form a cavity in which the rotor is captively held. However, when once assembled, the case can not be disassembled easily from the housing without destroying some the of the component parts whenever any position adjustment of the component parts such as the contact member is required.

It is another object of this invention to provide a case which may be assembled with or disassembled from the housing with ease without destroying any component parts thereof.

Other object and further applicability of the present invention will become apparent from the detailed description given hereinafter; it should be understood, however, that the detailed description and specific examples while being of preferred embodiments of the invention are given by way of illustration only, since various changes and modifications within the spirit and scope of the invention will become apparent of those skilled in the art from this detailed description.

DETAILED DESCRIPTION OF PREFERRED EMBODIMENT

The terminal leads of this invention are manufactured from a single plate of metallic material by any known method, for example, by means of a stamping or blanking technique.

Figure 3:
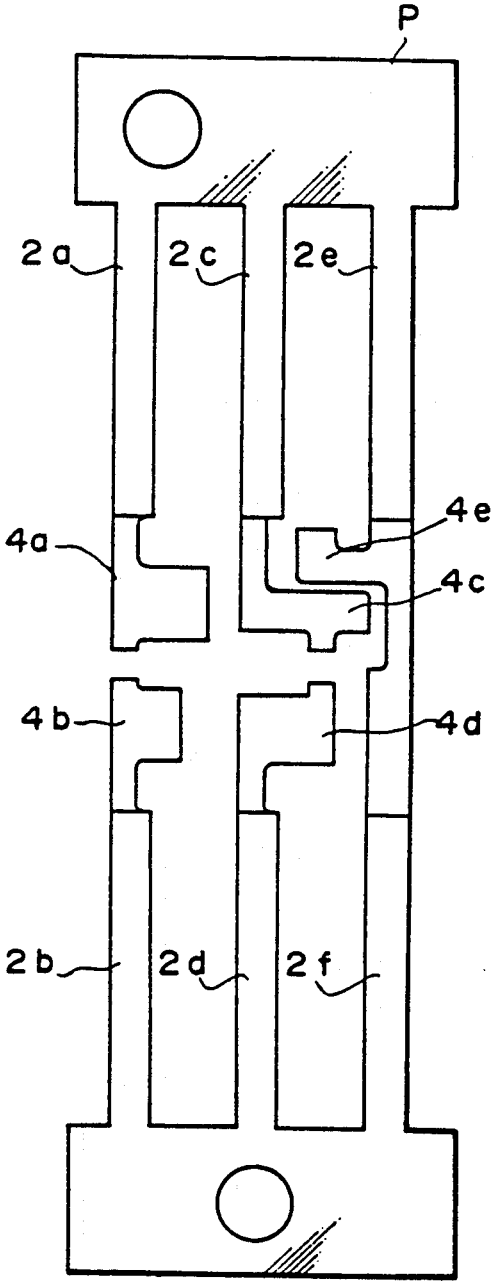
FIG. 3 is a plan view of terminal plate defined in a sheet of metal plate.

The terminal leads 2*a*, 2*b*, 2*c*, 2*d*, 2*e* and 2*f*, as shown in FIG. 3, are punched out of a piece of metal plate P which is preferably comprised of phosphor bronze.

Two output terminal leads 2*a* and 2*c* which are provided with fixed contacts 4*a* and 4*b* at the end thereof respectively extend in parallel from one side of the metal plate P while the other two output terminal leads 2*b* and 2*d* provided with fixed contacts 4*b* and 4*d* at the end thereof respectively extend in parallel from the other side of metal plate P in opposite relation to the terminal leads 2*a* and 2*c*respectively.

Figure 1:
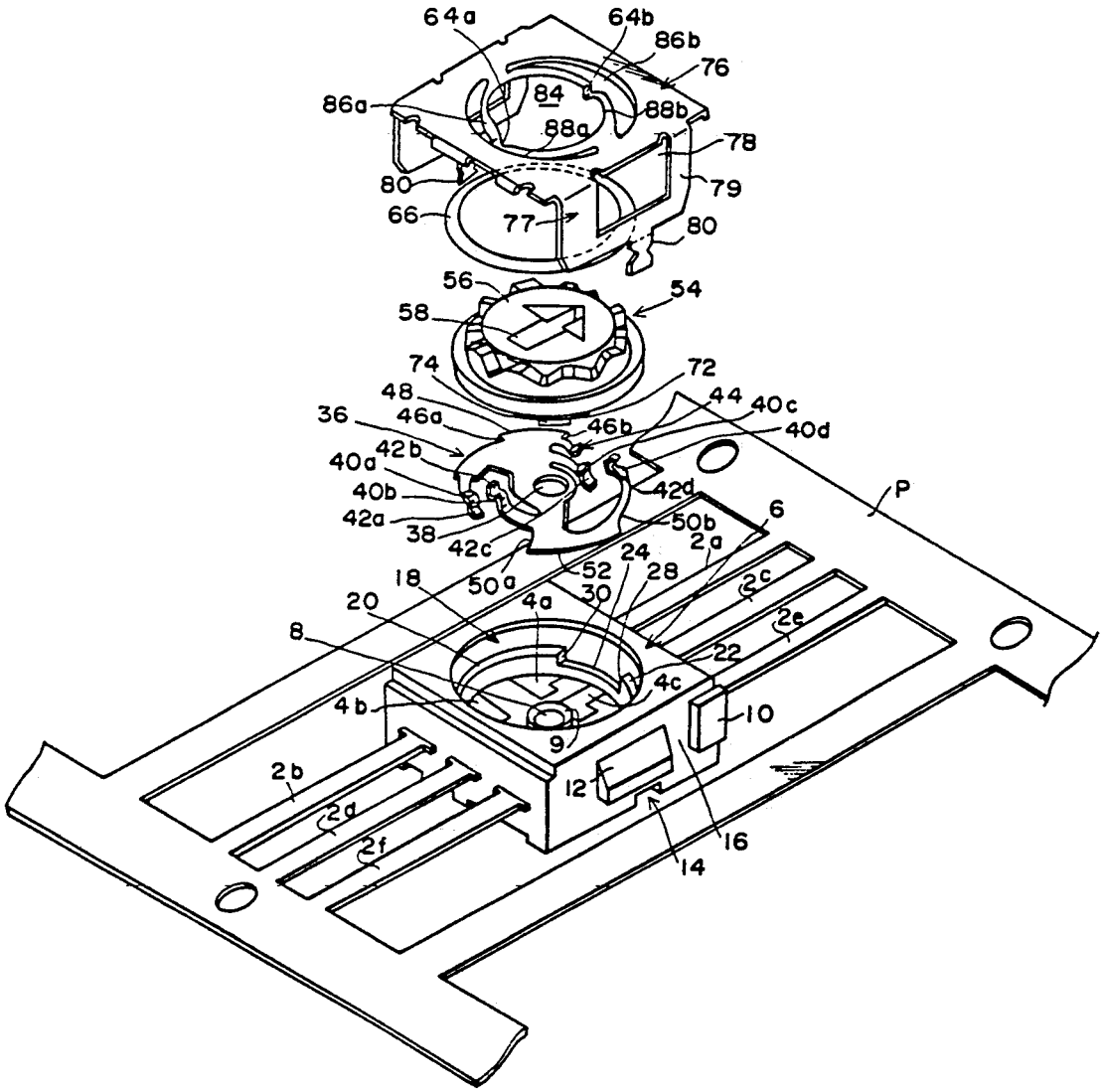
FIG. 1 is an exploded elevation perspective view of the switch of this invention with the ends of the terminal plate uncut.
Figure 2:
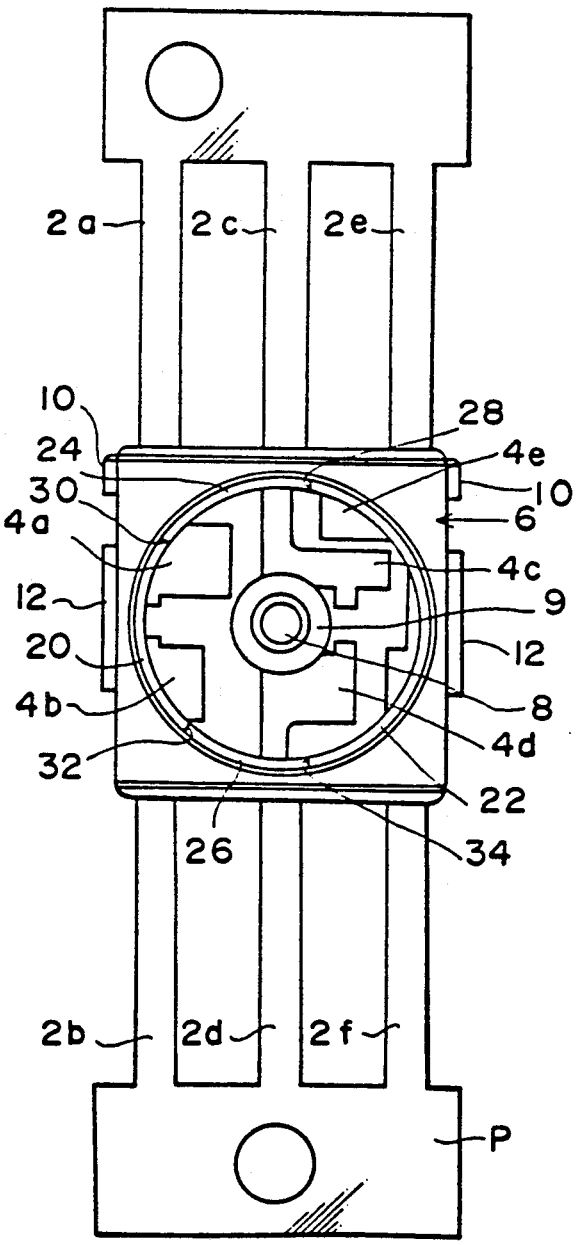
FIG. 2 is a plan view of a housing having uncut ends of terminal plates inserted therein.

Numerals 2*e* and 2*f* are common terminal leads punched out of a piece of metal plate P. A common fixed contact 4*e* connects the two common terminal leads 2*e* and 2*f* spanning therebetween. These fixed contacts 4*a*, 4*b*, 4*c*, 4*d* and 4*e* are solder plated by any well-known soldering technique and these terminal leads 2*a*–2*f* are spaced in a housing 6, as shown in FIG. 1 and FIG. 2 by an insert molding method. The housing 6 which is preferably of a molded plastic material has a chamber 18 provided with a hole 8 defined in the bottom center thereof and a cylindrical support 9 is arranged around the hole 8.

A pair of edge projections 10 and a pair of center projections 12 are arranged at spaced positions on both sides of the housing 6 such that clearances 16 provided are therebetween. Apair of grooves 14 are also defined in the bottom edges of the housing 6.

The chamber 18 is provided with a ledge with a pair of ledge portions 20 and 22 circumferentially spaced and in which are provided a first recess means in the form of a recess 24 and a second recess means in the form of a recess 26, each having a pair of vertical walls 28, 30 and 32, 34 respectively at the ends thereof so as to extend in the depth direction of said chamber.

Figure 4:
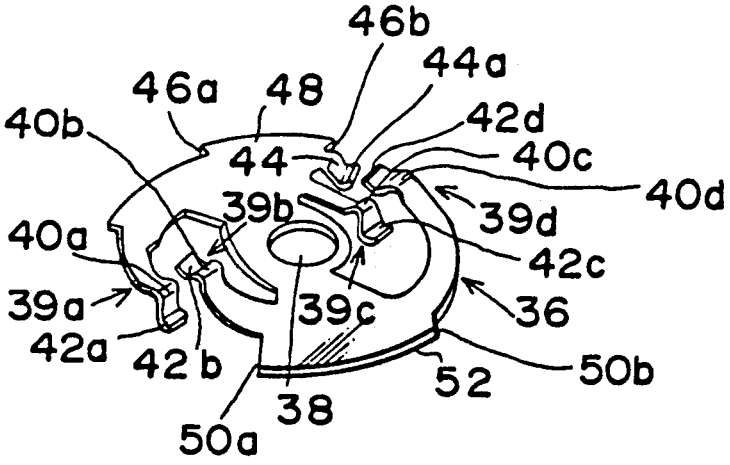
FIG. 4 is a perspective view of a contact member of this invention.
Figure 5:
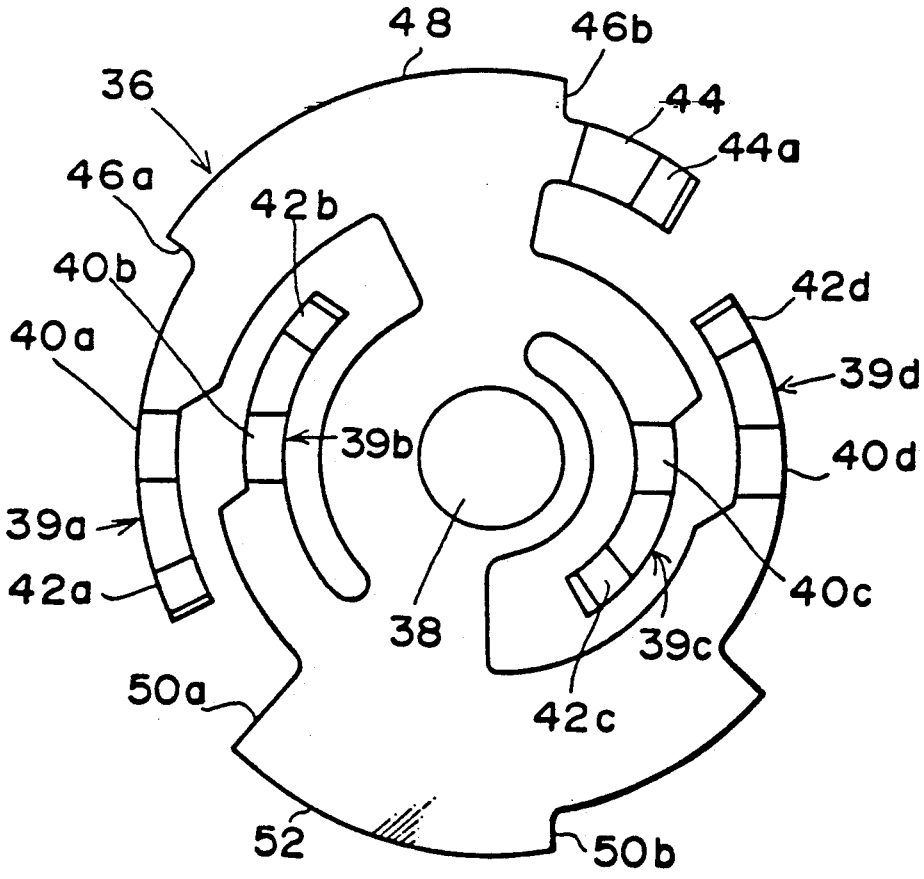
FIG. 5 is an enlarged plan view of a contact member like that of FIG. 4.
Figure 6:
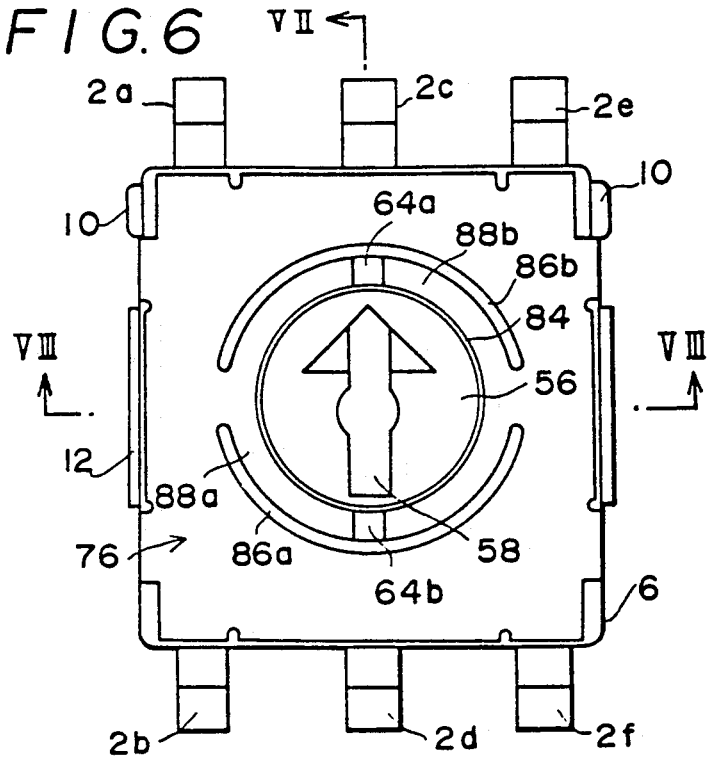
FIG. 6 is a plan view of a switch of this invention.
Figure 7:
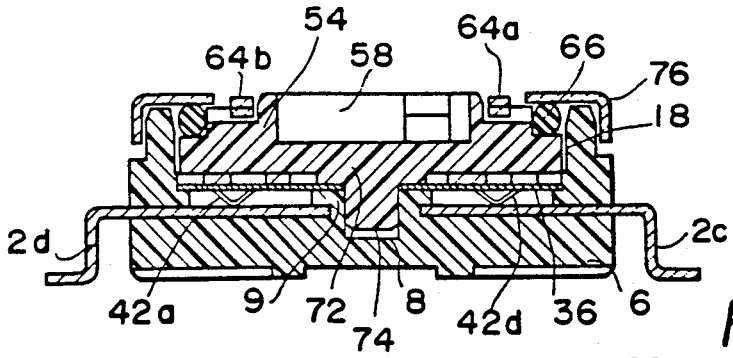
FIG. 7 is a sectional view of the switch of FIG. 6 along line VII—VII.
Figure 8:
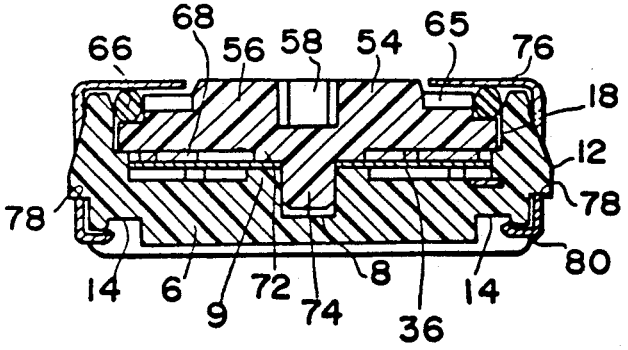
FIG. 8 is a sectional view of the switch of FIG. 6 along line VIII—VIII.

A contact member 36 which can be positioned in the chamber 18 of the housing 6 when the switch is assembled will be described in reference to FIGS. 4 and 5. The contact member 36 is a planar circumferential plate which is preferably comprised of conductive metal and has a hole 38 defined in the center thereof. A plurality of circumferentially extending output contact fingers 39*a*, 39*b*, 39*c*, 39*d* and a common contact finger 44 are spaced circumferentially around the center hole 38. The contact fingers 39*a* and 39*b* are radially spaced and extend in opposite directions. Contact fingers 39*c* and 39*d* are similarly arranged. Each contact fingers 39*a*, 39*b*, 39*c*, 39*d* is provided with a projection 40*a*, 40*b*, 40*c* and 40*d* on the surface thereof projecting in one direction from the plane of the plate and with a contact point 42*a*, 42*b*, 42*c*, 42*d* at the end thereof. The common contact finger 44 has a contact point 44*a* which is in spaced opposed relation to the contact finger 39*d*.

The circumference of the contact member 36 has two radially projecting ridges 48 and 52 each of which is provided with faces 46*a*, 46*b* and 50*a*, 50*b* at a circumferential end thereof which extend perpendicular to the plane of the plate. The ridges 48 and 52 may fittedly engage with the recesses 24 and 26 defined between the ledge portions 20, 22 respectively, as will hereinafter be explained. The recesses 24 and 26 and the corresponding projecting ridges 48 and 52 are asymmetrically positioned around the periphery of said chamber 18 and the edge of said contact member 36.

The rotor 54 provided with a protruding head 56 is held captive in an open top cavity formed between the housing 6 and the case 76.

Figure 9:
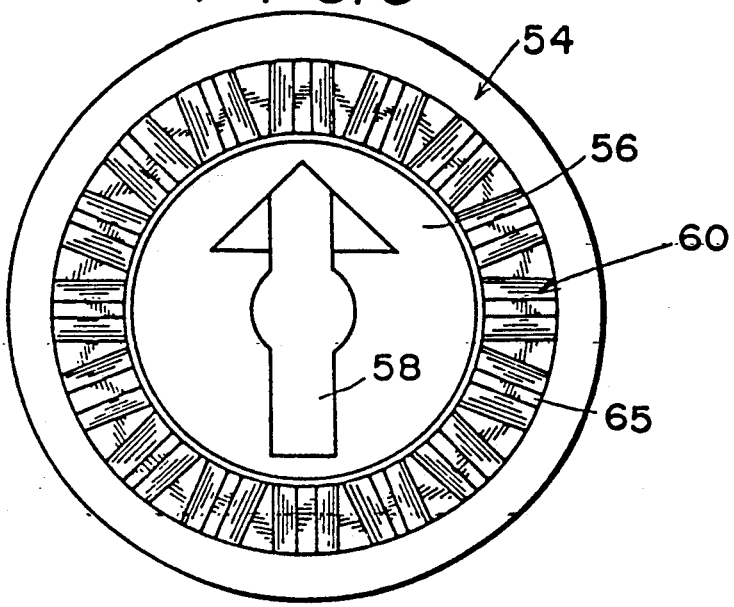
FIG. 9 is a plan view of a rotor.
Figure 10:
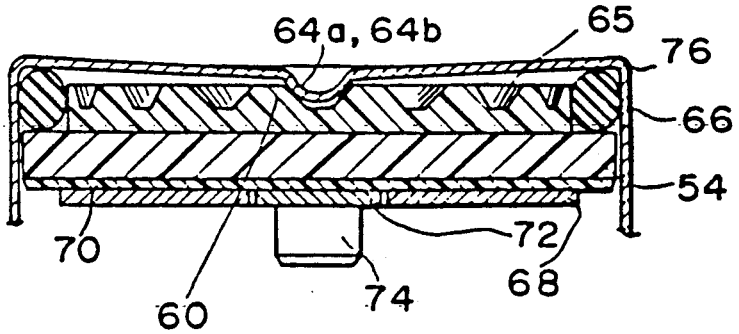
FIG. 10 is a sectional view of a rotor and a case.

A slot 58 is defined in an upper surface of the rotor head 56. When the rotor 54 is rotated, for example, by the rotation of a screw driver or the like engaged in the slot 56, a plurality of cams 60 separated by grooves 65 which are defined in the rotor 54 and spaced circumferentially around the rotor head 56 as best shown in FIGS. 9 and 10, are engaged with projections 64*a* and 64*b* protruding toward the cams 60 from semi-circumferential strips 88*a*, 88*b* formed in the case 76.

An O-ring 66 is also positioned between the rotor 54 and the case 76 thereby to prevent undesirable material from passing inwardly toward the cavity.

Figure 11:
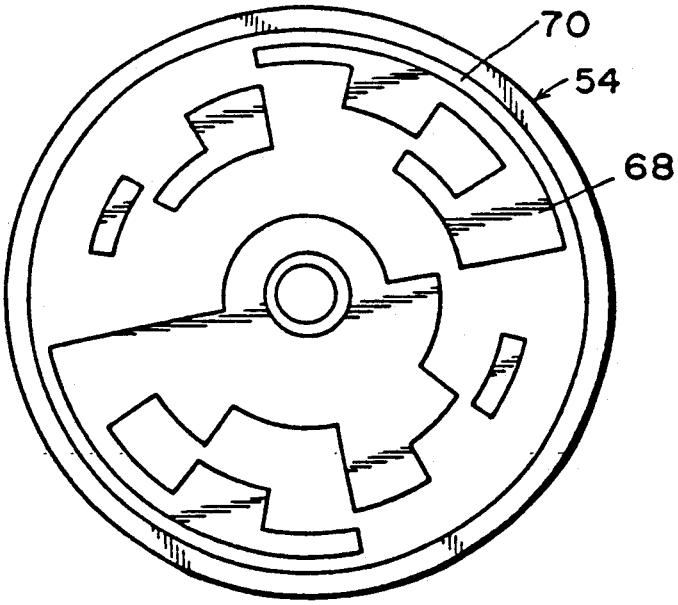
FIG. 11 is a plan view of a cam pattern arranged on the undersurface of a rotor.
Figure 12:
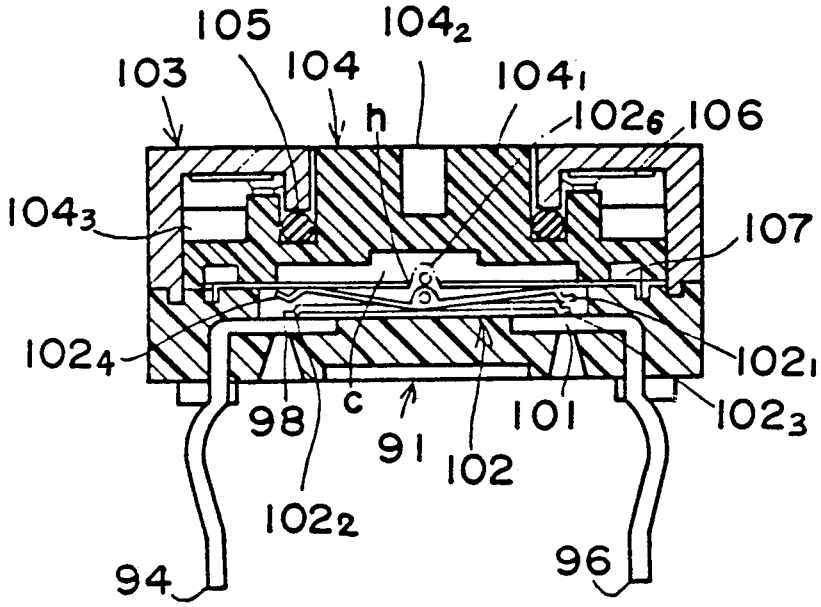
FIG.12 (PRIOR ART)
FIG. 12 is a sectional view of a rotary switch of the prior art.
Figure 13:
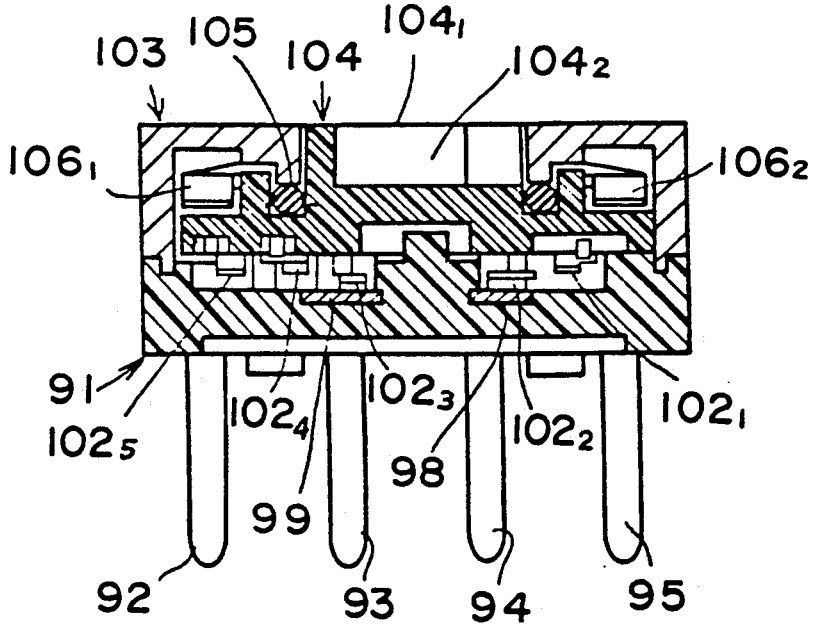
FIG.13 (PRIOR ART)
FIG. 13 is a sectional view of the rotary switch of the prior art sectioned at an angle different from FIG. 12.
Figure 14:
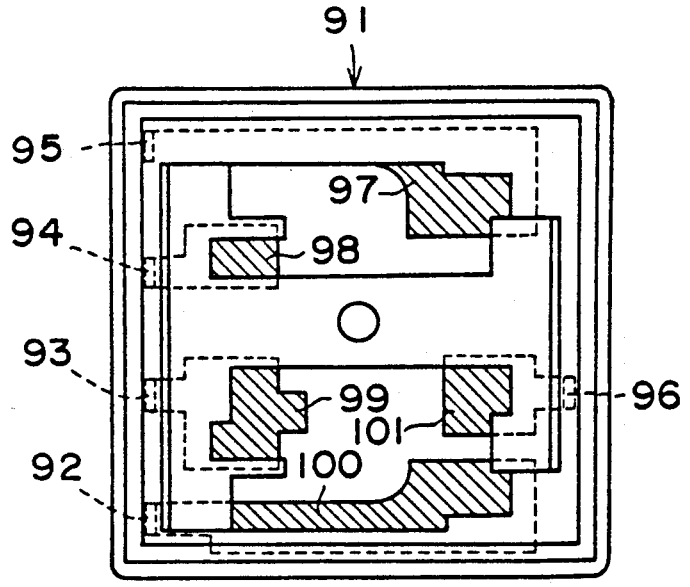
FIG. 14 (PRIOR ART)
FIG. 14 is a plan view of the housing of the prior art.
Figure 15:
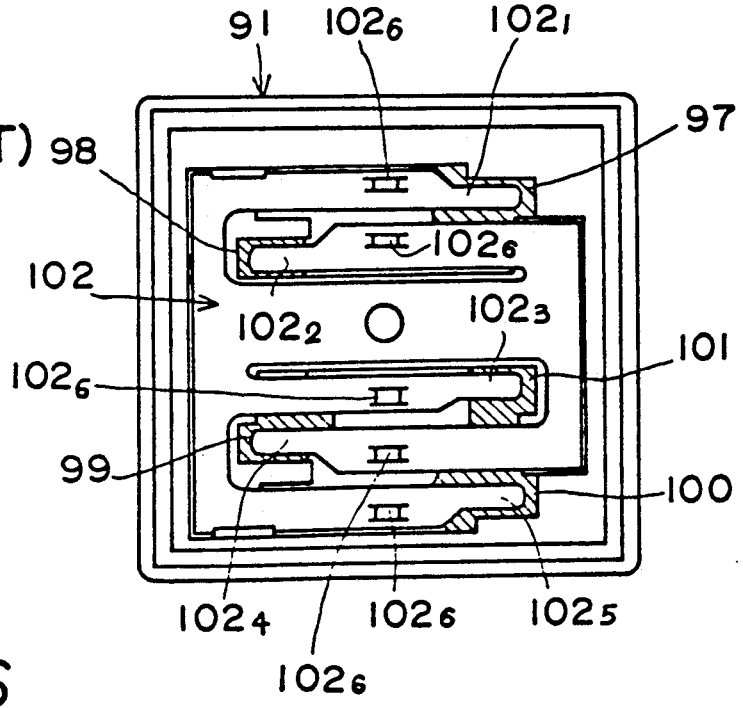
FIG. 15 (PRIOR ART)
FIG. 15 is a plan view of a housing on which a contact member of the prior art is positioned.
Figure 16:
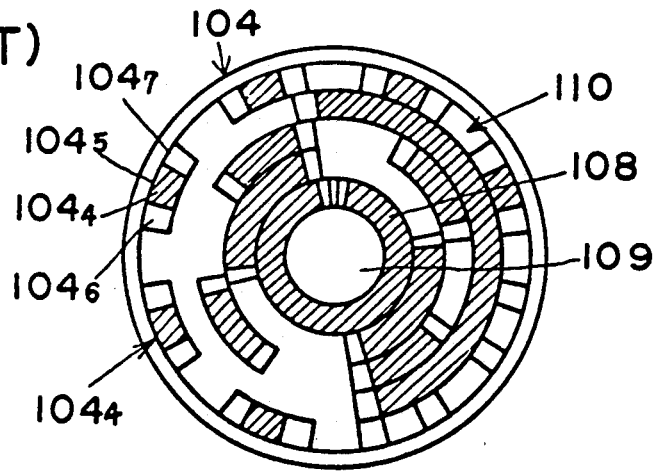
FIG. 16 (PRIOR ART)
FIG. 16 is a plan view of cam patterns arranged on an undersurface of a rotor of the prior art.

As best shown in FIG. 11, a circuit board 70 carrying cam patterns 68 is fittedly arranged on an undersurface of the rotor 54. The cam patterns 68 are spaced radially and in the direction of rotation of the rotor 54. Upon the rotation of the rotor 54, these cam patterns 68 wipably touch contact projections 40*a*, 40*b*, 40*c*, 40*d* of the contact fingers 39*a*, 39*b*, 39*c*, 39*d* in seriatim as will be hereinafter be explained.

The rotor 54 is provided with a depending shaft 74 extending downward from a pedestal 72 thereof. The center hole 8 of the housing 6 provided within a support portion 9 receives the depending shaft 74 of the rotor 54 with the contact member 36 being sandwiched therebetween, and the rotor 54 can be rotated together with the circuit board 70, so that the cam patterns 68 wipably touch 40*c*, contact projection 40*a*, 40*b*, 40*c*, 40*d* in seriatim.

The contact member 36 can be fixedly positioned within the chamber 18 of the housing 6 in the following way. The circular arc projecting ridge 48 of the contact member 36 is insertedly engaged in the first recess 24 defined in the ledge 20, 22 arranged in the housing chamber 18 while the other circular arc projecting ridge 52 is engaged in the second recess 26 defined in the ledge 20, 22 whereby the contact member 36 is fixedly positioned within the chamber 18. The contact points 42*a*, 42*b*, 42*c*, 42*d* thereof are in spaced opposed relation to the fixed contacts 4*b*, 4*a*, 4*d*, 4*c* of terminal leads 2*b*, 2*a*, 2*d*, 2*c*, with a small clearance therebetween, while the contact point 44*a* of the common contact finger 44 is in continuously contacting relation with the fixed contact 4*e* of common terminal leads 2*e* and 2*f*.

The case 76 comprised of resilient material is provided with a pair of semi-circumferential slits 86*a*, 86*b* arranged around a center hole 84 thereof. The pair of semi-cicumferential resilient strips 88*a*, 88*b* are formed between the hole 84 and the semi-circumferential slits 86*a*, 86*b* respectively. The semi-circumferential resilient strips 88*a*, 88*b* are provided with projection 64*a*, 64*b* respectively protruding downwardly from the center thereof. The projections 64*a*, 64*b* are engaged with cams 60 defined in the rotor 54 arranged around the rotor head 56 upon the rotation of the rotor 54.

The case 76 is also provided with holes 78 defined in the center of downwardly bent legs 77 and having frames 79 therearound. A pair of depending lugs 80 are formed at the bottom edges of the bent legs 77.

The case 76 may be assembled with the housing 6 with the projection 12 being slidably snapped into holes 71 defined in the pair of bent legs 77 of the case 76, while frames 79 of the bent legs 77 fit into the clearance 16 on the housing 6 defined between the projections 12 and 10 thereof whenever the case 76 is pushed down upon the housing 6, and the depending lugs 77 are crimped inwardly into the groove 14 defined in the housing bottom.

When the case 76 is thus assembled with the housing, the depending shaft 74 of the rotor 54 is received by the center hole 8 of the housing 6 defined in the support portion 9 whereby the rotor 54 is rotatably and smoothly held in the chamber 18 with the contact member 36 being sandwiched between the rotor 54 and the housing 6.

The contact member 36 is fixedly positioned within the chamber 18 as heretofore explained.

Therefore, the detailed description of the assembling of the contact member 36 with the housing 6 is eliminated for brevity.

After the completion of assembling as thus explained, the individual terminal leads 2*a*, 2*b*, 2*c*, 2*d*, 2*e* and 2*f* are formed by cutting the edge of metal plate P so the terminal leads have a predetermined length.

The operation of the rotary switch of this invention will be described hereunder.

By rotating a screw driver or the like applied to the slot 58 in the rotor head 56 in a clockwise or a counterclockwise direction, the rotor 54 which is held in the housing chamber 18 rotated in the corresponding direction whereby the cam pattern 68 of the circuit board 70 fixedly attached to the undersurface of the rotor 54 wipably slides on the contact member 36 in the corresponding direction thereby to touch on one of the corresponding contact projections 40*a*, 40*b*, 40*c*, 40*d* in seriatim and push one of the corresponding contact points 42*a*, 42*b*, 42*c*, 42*d* onto one of the corresponding fixed contacts 4*b*, 4*a*, 4*d*, 4*c* of lead terminals 2*b*, 2*a*, 2*d*, 2*c* respectively whereby one of the contact fingers 39*a*, 39*b*, 39*c*, 39*d* is electrically connected to one of the lead terminals 2*b*, 2*a*, 2*d*, and 2*c* while the contact point 44*a* of common contact finger 44 keeps continual contact with the common fixed contact 4*e* connecting common terminals 2*e* and 2*f* whenever the contact member 36 is assembled within the housing chamber, as heretofore explained.

The configuration of the cam pattern 68 arranged on the circuit board 70 is designed for hexadecimal notation.

What is claim is:

1. A rotary switch, comprising:

a housing having an upwardly open chamber opening out of the top of said housing;

terminal lead fixed contacts in said housing exposed in the bottom of said chamber and spaced from each other in an asymmetrical pattern;

a planar plate-shaped contact member fixedly positioned in said chamber and having a plurality of output contact fingers corresponding to the respective terminal lead fixed contacts and movable transversely of the plane of said contact member and each output contact finger having a contact projection thereon and a contact point thereon and said contact fingers being exposed to corresponding terminal lead fixed contacts in the bottom of said chamber with the contact points normally spaced from said terminal lead fixed contacts;

a rotor rotatably mounted in said chamber and having cam patterns on the under side thereof toward said contact member for engagement with the contact projections on corresponding ones of said contact fingers for causing said contact points to contact said terminal lead contacts in the bottom of said chamber seriatim as said rotor is rotated, and further having click cams around the top thereof;

said housing having a pair of opposite side walls and a center projection projecting laterally of said housing from each side wall, and having a corner projection projecting laterally from each said side wall and spaced from the respective center projections toward one side of said housing for defining a clearance therebetween, said housing further having grooves in the bottom thereof opening out of the bottom edge of said opposite side walls; and a case having a top wall with a central aperture therein through which the upper portion of said rotor extends, and having depending walls depending from opposite side edges of said top wall along said opposite side walls of said housing, said depending walls each having a side aperture in the center thereof for fitting in snapping engagement over a corresponding center projection and having a frame portion depending along one side of said side aperture having a width for fitting into said clearance and having a further frame portion extending along the other side of said side aperture having a width greater than said clearance, and depending lugs extending from the bottoms of said depending walls and bent into said grooves for fixedly. holding said case on said housing, and said casing further having click projections depending from said top wall for engagement with said click cams on said rotor for producing an audible click when said rotor is rotated, whereby said case can be fitted onto said housing oriented in only one direction toward said one side of said housing.

* * * * *

UNITED STATES PATENT AND TRADEMARK OFFICE

CERTIFICATE OF CORRECTION

PATENT NO. : 5,008,498

DATED : April 16, 1991

INVENTOR(S) : Atsuo YAMAZAKI

It is certified that error appears in the above-identified patent and that said Letters Patent is hereby corrected as shown below:

column 5, line 2, read "touch [40c] contact projection 40a, 40b, 40c,40d in seria-".

Signed and Sealed this

Tenth Day of November, 1992

*Attest:*

DOUGLAS B. COMER

*Attesting Officer*

*Acting Commissioner of Patents and Trademarks*